US006952897B1

(12) United States Patent
Mauer

(10) Patent No.: US 6,952,897 B1
(45) Date of Patent: Oct. 11, 2005

(54) WINDOW COVERING

(76) Inventor: Brian B. Mauer, 171 Lincoln St., Denver, IA (US) 50622

( * ) Notice: Subject to any disclaimer, the term of this patent is extended or adjusted under 35 U.S.C. 154(b) by 0 days.

(21) Appl. No.: 10/384,145

(22) Filed: Mar. 10, 2003

(51) Int. Cl.[7] ..... E05B 65/04
(52) U.S. Cl. ..... 49/63; 49/61; 49/413
(58) Field of Search ..... 49/61, 63, 68, 49/366, 370, 404, 413; 160/10, 368.1; 40/611.01

(56) References Cited

U.S. PATENT DOCUMENTS

| | | | | |
|---|---|---|---|---|
| 4,397,346 | A | 8/1983 | Chumbley et al. | |
| 4,418,739 | A | 12/1983 | Woolnough et al. | |
| 4,436,137 | A | 3/1984 | Charles | |
| 4,799,524 | A | 1/1989 | Guermonprez | |
| D371,928 | S | 7/1996 | Evly | |
| 5,681,259 | A * | 10/1997 | August | 600/27 |
| 5,850,864 | A | 12/1998 | Decker | |
| 5,893,242 | A * | 4/1999 | Perron | 52/202 |
| 5,930,927 | A * | 8/1999 | Griffin et al. | 40/621 |
| 6,021,608 | A * | 2/2000 | Ollison | 49/449 |
| 6,089,301 | A * | 7/2000 | Smith | 160/90 |
| 6,435,254 | B1 * | 8/2002 | Todd et al. | 160/309 |

* cited by examiner

*Primary Examiner*—Jerry Redman

(57) ABSTRACT

A window covering includes a frame including an upper wall and a lower wall, a first side wall and a second side wall. A window is mounted in the frame and has a length less than a length of the upper and lower walls. A guide assembly extends along a length of the frame. Each of a pair of panels is positioned in the guide assembly such that the panels are orientated substantially parallel to the window. The panels are selectively positioned in a closed position abutting each other in front of the window or in an open positioned spaced from each other.

15 Claims, 4 Drawing Sheets

WINDOW COVERING

BACKGROUND OF THE INVENTION

1. Field of the Invention

The present invention relates to window coverings and more particularly pertains to a new window covering which covers and insulates a window.

2. Description of the Prior Art

The use of window coverings is known in the prior art. These include drapes, shutters and blinds, some of which may also be positioned between planes of glass in a window. While these devices fulfill their respective, particular objectives and requirements, the need remains for a device that effectively blocks out all light from entering a room through a window and also aids in the insulation of the window.

SUMMARY OF THE INVENTION

The present invention meets the needs presented above by providing panels which effectively close off the window from the interior of a room.

Another object of the present invention is to provide a new window covering that may be slid into a stored position which exposes the window and hides the panels so that they are not viewed.

Still another object of the present invention is to provide a new window covering that allows optionally decorated coverings to be positioned on the panel.

To this end, the present invention generally comprises a frame including an upper wall and a lower wall, a first side wall and a second side wall. A window is mounted in the frame and has a length less than a length of the upper and lower walls. A guide assembly is attached to and extends along a length of the frame. Each of a pair of panels is positioned in the guide assembly such that the panels are orientated substantially parallel to the window. The panels are selectively positioned in a closed position abutting each other in front of the window or in an open positioned spaced from each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
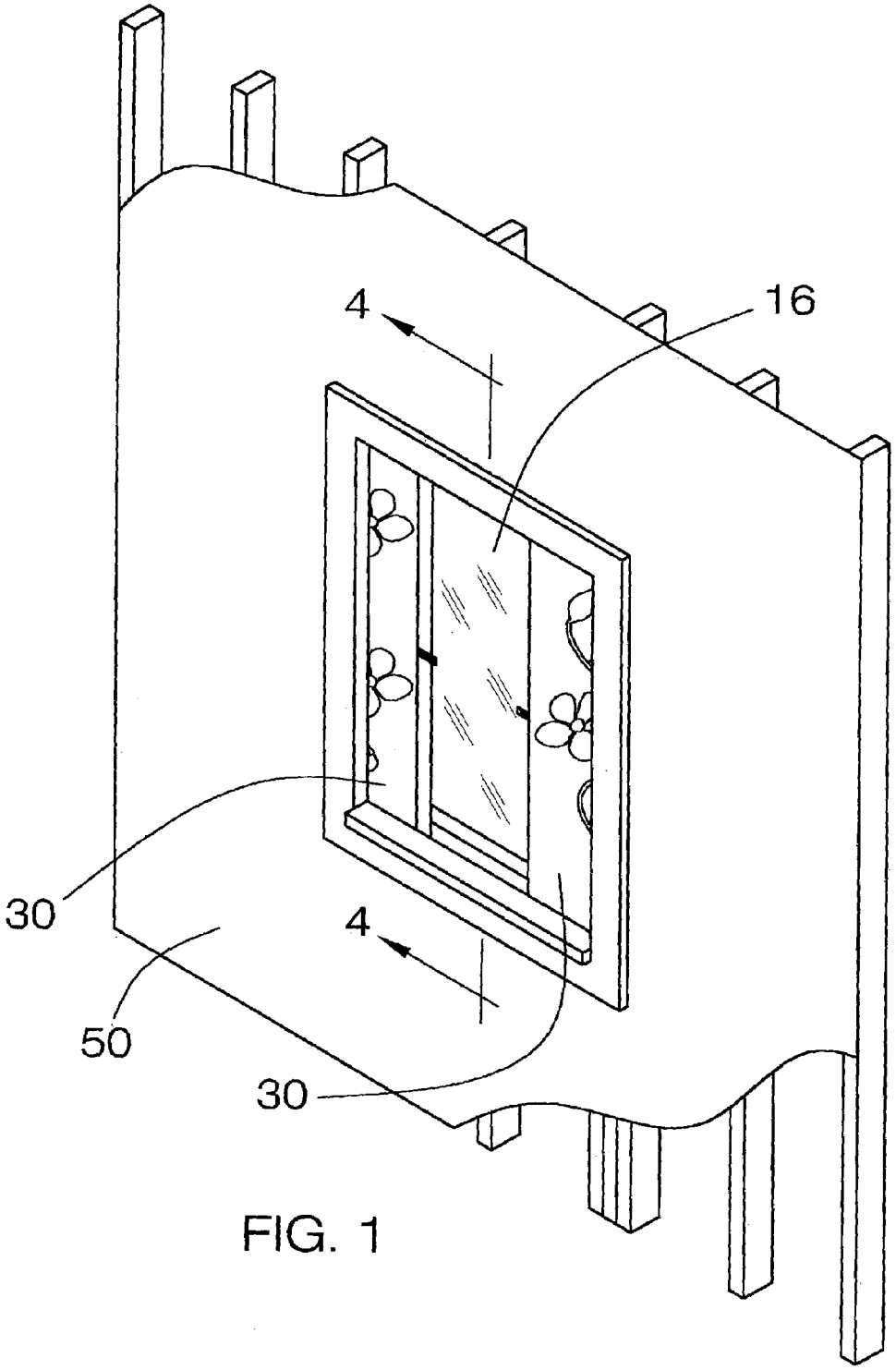
FIG. 1 is a schematic perspective in-use view of a window covering according to the present invention.
Figure 2:
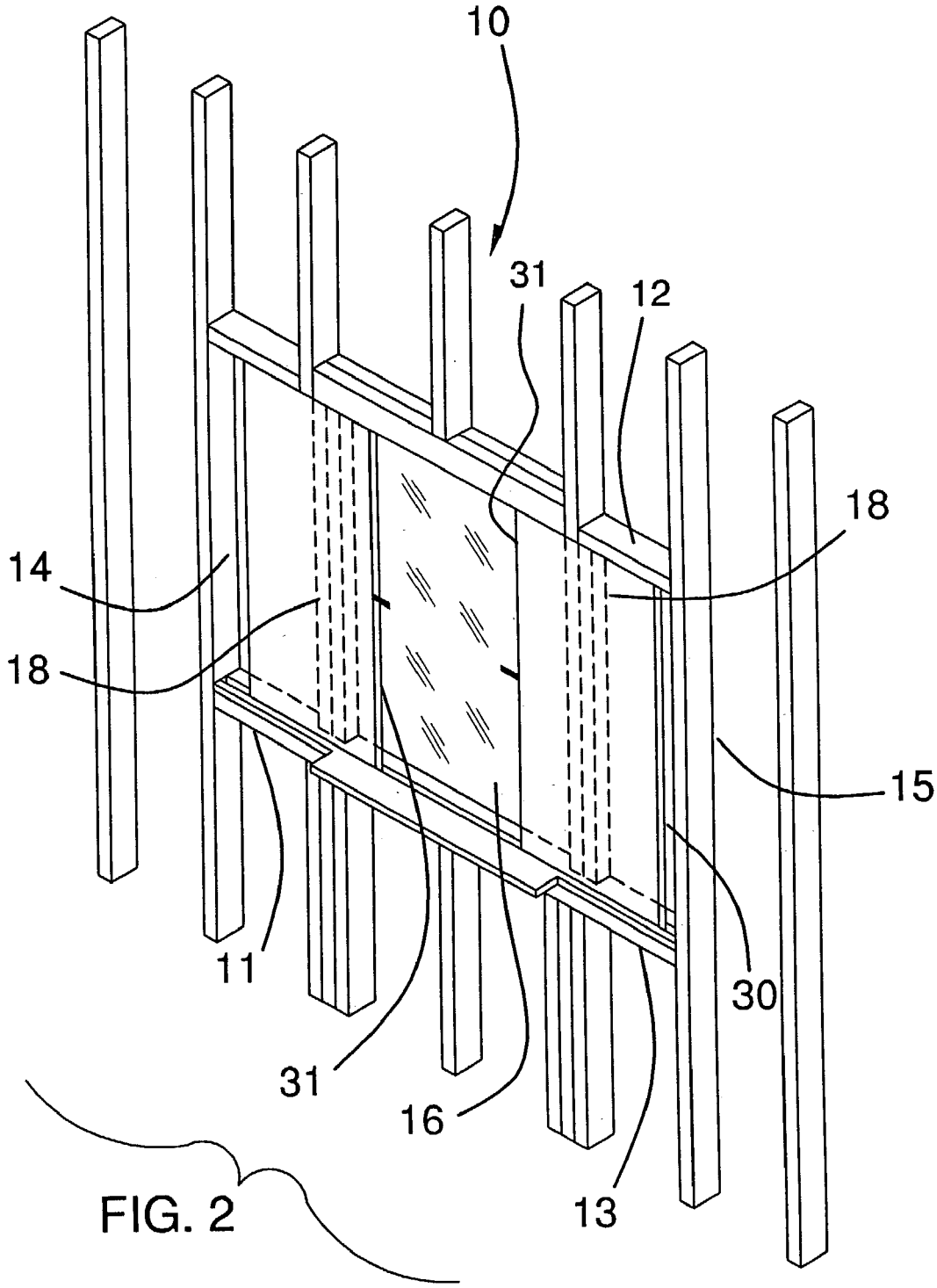
FIG. 2 is a schematic perspective view of the present invention.
Figure 3:
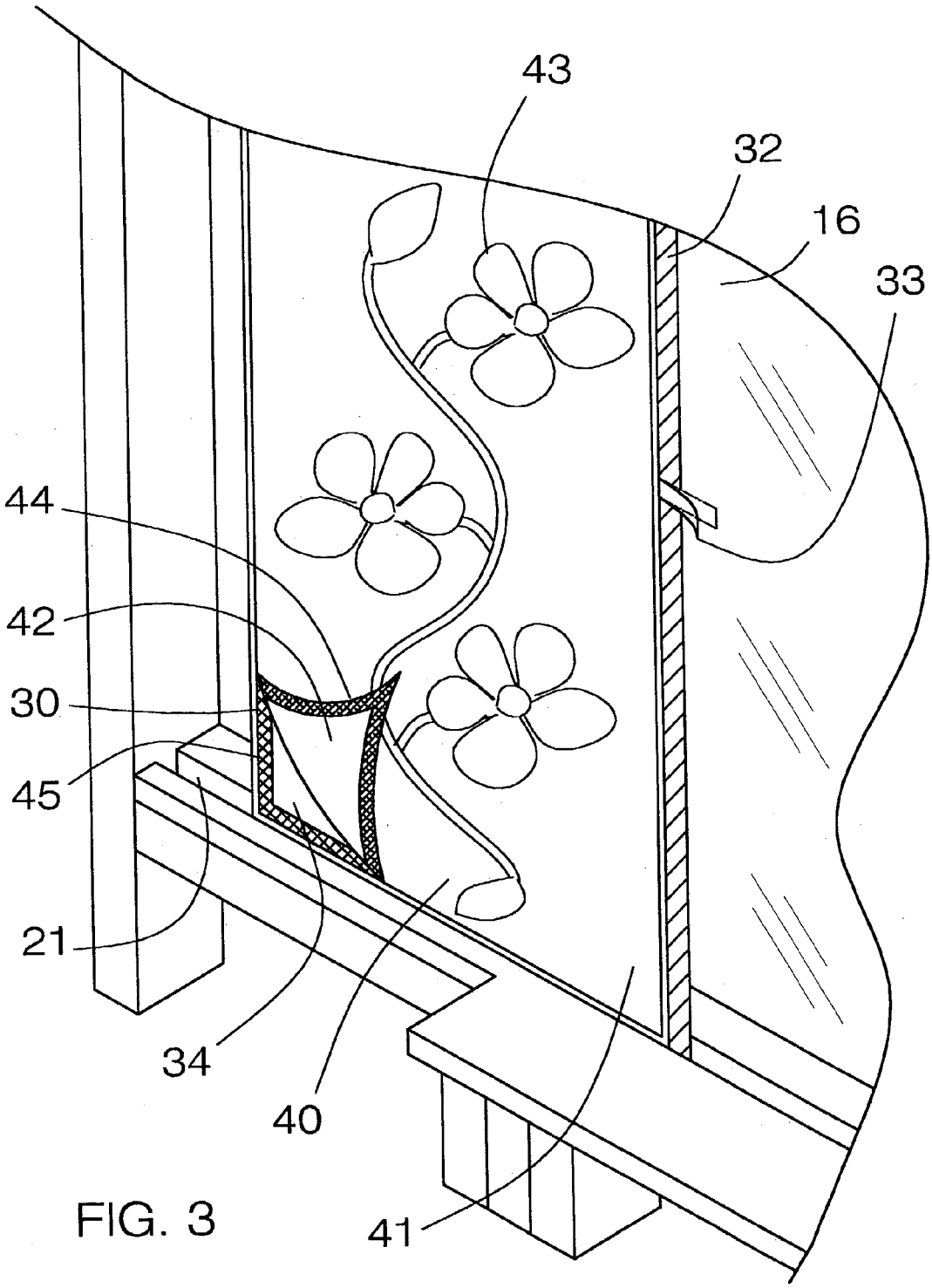
FIG. 3 is a schematic perspective view of the present invention.
Figure 4:
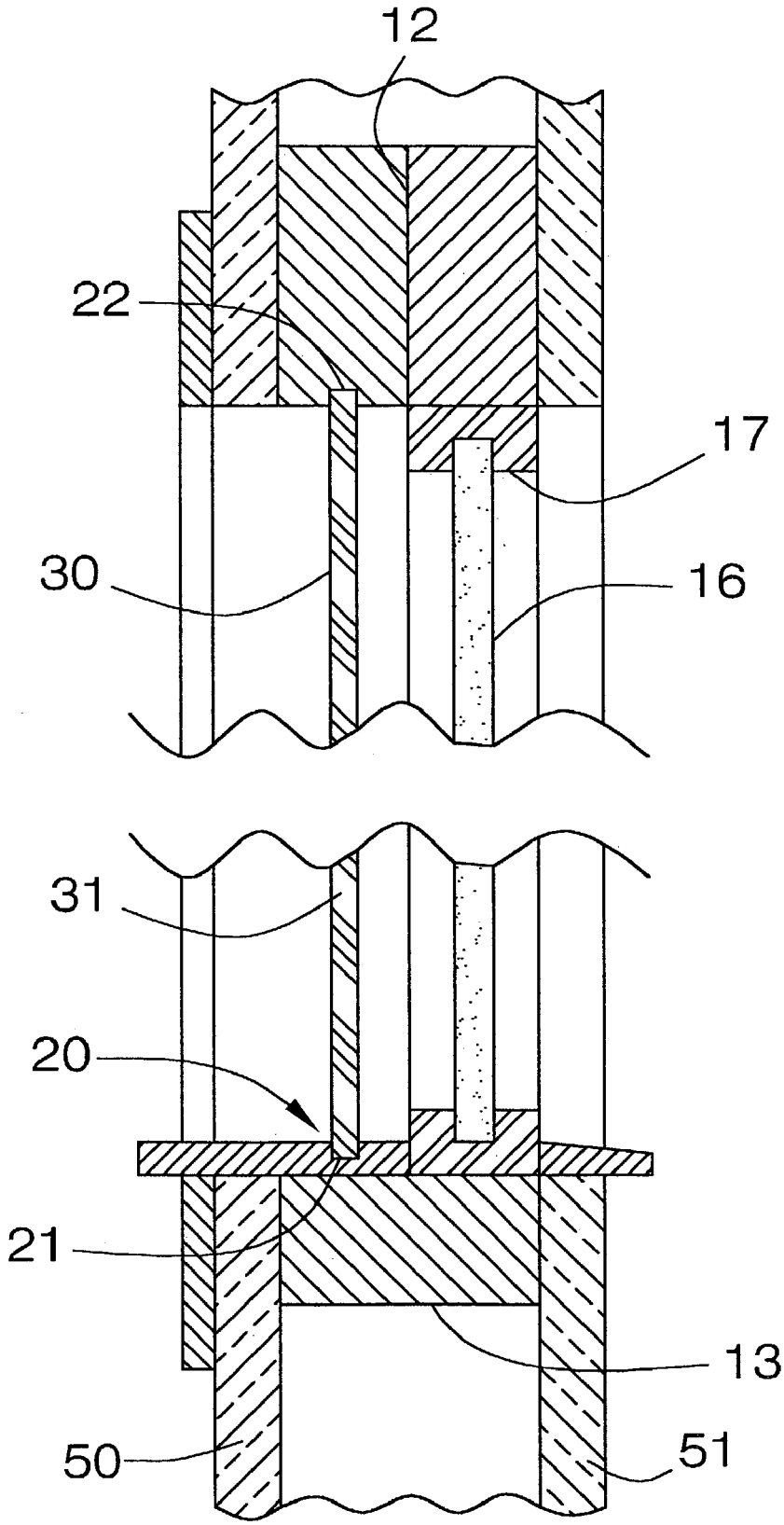
FIG. 4 is a schematic cross-sectional view of the present invention taken along line 4—4 of FIG. 1.

With reference now to the drawings, and in particular to FIGS. 1 through 4 thereof, a new window covering embodying the principles and concepts of the present invention and generally designated by the reference numeral 10 will be described.

As best illustrated in FIGS. 1 through 4, the window covering 10 generally comprises a frame 11 including an upper wall 12, a lower wall 13, a first side wall 14 and a second side wall 15. It is to be understood that the frame 11 of the invention is larger than a window 16 being mounted therein. Thus, when a window 16, which includes its own window frame 17, is mounted in the frame 11, the window 16 and has a length less than a length of the upper 12 and lower 13 walls. The term window 16 shall generally include the pane of glass and the frame it is supported in, though the window frame 17 shall be designated separately for clarification. The window 16 is positioned generally between the first 14 and second 15 side walls. This leaves a space between side edges 18 of the window frame 17 and first 14 and second 15 side walls of the frame 11.

A guide assembly 20 extends along a length of the frame. The guide assembly 20 includes an elongated bottom guide track 21 that is positioned on an upper surface of the lower wall 13 and an elongated top guide track 22 that is positioned on a lower surface of the upper wall 12. The top 22 and bottom 21 guide tracks are positioned in a plane orientated substantially parallel to and spaced from a plane of the window 16. Each of the bottom 21 and top 22 guide tracks has a length longer than a length of the window 16 and extend from the first side wall 14 to the second side wall 15 of the frame 11. The window 16 is mounted into the frame 11 such that the top 22 and bottom 21 guide tracks each extend beyond both side edges 18 of the window 16. The top 22 and bottom 21 guide tracks may include rails or other types of guide tracks but it is preferred that each of the top 22 and bottom 21 guide tracks comprises a slot 23 in a respective one of the upper 12 and lower 13 walls.

Each of a pair of panels 30 is positioned in and extends between the top 22 and bottom 21 guide tracks. Each of the panels 30 has a length at least equal to one-half the length of the window 16. The panels 30 each have an inner edge 31 such that the inner edges 31 may be abutted. The panels 30 are selectively positioned in a closed position abutting each other in front of the window 16 or in an open position spaced from each other such that the window 16 is exposed. It should be understood, that the invention would also work with only one panel 30, having a size at least as large as the window 16, which is positioned in the guide tracks 20. The panels 30 are preferably constructed of a rigid material.

A securing assembly 32 is attached to the panels 30 for selectively securing the panels in the closed position. The securing assembly 32 includes magnetic strips that are attached to and extend along the inner edges 31 of the panels 30. The securing members 32 may include other types of conventional mechanical fasteners.

Each one of a pair of gripping members 33 is attached to one of the panels 30. Each of the gripping members 33 is positioned generally adjacent to a respective one of the inner edges 30. The gripping members 33 are preferably tabs that extends away from one of the inner edges such that the tabs extend outward when the panels 30 are in the open position.

At least two coverings 40 are selectively positionable over the panels 30. The coverings 40, at least one for each panel, are to be positioned on an outer surface 34 of the panels 30 facing away from the window 16. Each of the coverings 40 has a first side 41 and a second side 42 wherein at least one of the first 41 or second 42 sides has decorative indicia 43 thereon. In the case of one panel 30, only one covering 40 would be needed, although it would preferred that a plurality of coverings 40 are available so that the user may select between various designs.

An attachment means releasably attaches the coverings 40 to the panels 30. The attachment means includes a first attachment element 44 attached to a periphery of the coverings 40 and a second attachment element 45 attached to a periphery of the outer surface 34 of the panels 30. The attachment means may include buttons, snaps, adhesives or other mechanical fasteners but preferably comprises a hook and loop type attachment.

In use, the frame 11 is mounted into a wall as would a conventional window frame 17 would be, except that the window 16 (and its window frame 17) would be mounted into the frame 11 such that there is space between side edges of the window 18 and the frame 11. Panels 30 are slidably mounted into the guide tracks 20 so that they may be moved either in front of the window 16 or away from the window 16 in the space between the window 16 and the first 14 and second 15 side walls. Coverings 40 may be used to change the look of the panels 30. The user would typically place the frame 11 between an interior wall 50 and an exterior wall 51 such that only the window 16 is exposed. Thus, when the panels 30 are positioned in the open position, the panels 30 are hidden behind the interior wall 51.

The panels 30 aid in insulating the window which will lower heating and cooling costs. Additionally, the panels 30 will also help to insulate the windows for sound dampening purposes. Different panels 30 are envisioned for different purposes. The panels may be completely opaque for blocking out all light where desired such as in a bedroom, while panels 30 comprised of a translucent material may be used in kitchens for permitting some light to travel through panels. For this reason, the panels 30 may selectively be constructed of wood, glass, metal, plastic or other building materials. The panels 30 are positioned and used in such a manner as to not interfere with traditional window coverings such as drapes, curtains or blinds.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window assembly comprising:

a frame including an upper wall and a lower wall, a first side wall and a second side wall, a window being mounted in said frame and having a length less than a length of said upper and lower walls, said frame being mounted in a wall;

a guide assembly being positioned in and extending along a length of said frame;

a pair of panels, each of said panels being positioned in said guide assembly, said panels being orientated substantially parallel to said window, said panels being selectively positioned in a closed position abutting each other in front of and covering said window or in an open position spaced from each other and exposing said window, each of said panels being rigid and opaque, each of said panels having an outer surface facing away from said window; and at least two coverings being removably positionable over said outer surface of said panels, each of said coverings having a first side and a second side wherein at least one of said first or second sides has decorative indicia thereon, an attachment means releasably attaches said coverings to said panels.

2. The assembly of claim 1, wherein said guide assembly includes:

a bottom guide track being positioned on an upper surface of said lower wall, said bottom guide track being elongated; and a top guide track being positioned on a lower surface of said upper wall, said top guide track being elongated.

3. The assembly of claim 2, wherein said top and bottom guide tracks are positioned in a plane orientated substantially parallel to and spaced from a plane of said window, each of said bottom and top guide tracks having a length longer than a length of said window, wherein said window is mounted into said frame such that said top and bottom guide tracks each extend beyond both of a pair of side edges of said window.

4. The assembly of claim 3, wherein each of said top and bottom guide tracks comprises a slot in a respective one of said upper and lower walls.

5. The assembly of claim 1, wherein each of said panels has a length at least equal to one-half the length of said window.

6. The assembly of claim 1, wherein each said panels each has an inner edge such that said inner edges may be abutted in said closed position, a securing assembly being attached to said panels for selectively securing said panels in said closed position.

7. The assembly of claim 6, wherein said securing assembly includes magnetic strips being attached to and extending along said inner edges of said panels.

8. The assembly of claim 1, further including a pair of gripping members, each of said gripping members being attached to one of said panels, each of said gripping members being positioned generally adjacent to a respective one of said inner edges.

9. The assembly of claim 1, wherein said attachment means includes a first attachment element attached to a periphery of said coverings and a second attachment element attached to a periphery of said outer surface of said panels.

10. A window assembly comprising:

a frame including an upper wall and a lower wall, a first side wall and a second side wall, a window being mounted in said frame and having a length less than a length of said upper and lower walls, said frame being mounted in a wall;

a guide assembly being positioned in and extending along a length of said frame;

a panel being positioned in said guide assembly, said panel being orientated substantially parallel to said window, said panel being selectively positioned in a closed position in front of and covering said window or in an open position exposing said window, said panel being rigid and opaque, said panel having an outer surface facing away from said window; and a covering being removably positionable over said outer surface of said panel, said covering having a first side and a second side wherein at least one of said first or second sides has decorative indicia thereon, an attachment means releasably attaches said covering to said panel.

11. The assembly of claim 10, wherein said guide assembly includes:

a bottom guide track being positioned on an upper surface of said lower wall, said bottom guide track being elongated; and a top guide track being positioned on a lower surface of said upper wall, said top guide track being elongated.

12. The assembly of claim 11, wherein said top and bottom guide tracks are positioned in a plane orientated substantially parallel to and spaced from a plane of said window, each of said bottom and top guide tracks having a length longer than a length of said window, wherein said window is mounted into said frame such that said top and bottom guide tracks each extend beyond at least one of a pair of side edges of said window.

13. The assembly of claim 10, further including a gripping member being attached to said panel.

14. A window covering assembly comprising:

a frame including an upper wall and a lower wall, a first side wall and a second side wall, a window being mounted in said frame and having a length less than a length of said upper and lower walls, said window being positioned generally between said first and second side walls;

a guide assembly extending along a length of said frame, said guide assembly including:

a bottom guide track being positioned on an upper surface of said lower wall, said bottom guide track being elongated;

a top guide track being positioned on a lower surface of said upper wall, said top guide track being elongated, said top and bottom guide tracks being positioned in a plane orientated substantially parallel to and spaced from a plane of said window, each of said bottom and top guide tracks having a length longer than a length of said window, wherein said window is mounted into said frame such that said top and bottom guide tracks each extend beyond both of a pair of side edges of said window, each of said top and bottom guide tracks comprising a slot in a respective one of said upper and lower walls;

a pair of panels, each of said panels being positioned in and extending between said top and bottom guide tracks, each of said panels having a length at least equal to one-half the length of said window, said panels each having an inner edge such that said inner edges may be abutted, said panels being selectively positioned in a closed position abutting each other in front of said window or in an open positioned spaced from each other;

a securing assembly being attached to said panels for selectively securing said panels in said closed position, said securing assembly including magnetic strips being attached to and extending along said inner edges of said panels;

a pair of gripping members, each of said gripping members being attached to one of said panels, each of said gripping members being positioned generally adjacent to a respective one of said inner edges;

at least two coverings for selectively positioning over an outer surface of said panels facing away from said window, each of said coverings having a first side and a second side wherein at least one of said first or second sides has decorative indicia thereon; and an attachment means releasably attaches said coverings to said panels, said attachment means including a first attachment element attached to a periphery of said coverings and a second attachment element attached to a periphery of said outer surface of said panels, said attachment means comprising a hook and loop attachment.

15. The assembly of claim 10, wherein said attachment means includes a first attachment element attached to a periphery of said covering and a second attachment element attached to a periphery or said outer surface of said panel.

* * * * *